US006975704B2

(12) United States Patent
Neumeier et al.

(10) Patent No.: US 6,975,704 B2
(45) Date of Patent: Dec. 13, 2005

(54) X-RAY TUBE WITH HOUSING ADAPTED TO RECEIVE AND HOLD AN ELECTRON BEAM DEFLECTOR

(75) Inventors: Ernst Neumeier, Aurachtal (DE); Wolfgang Kutschera, Aurachtal (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/760,071

(22) Filed: Jan. 16, 2004

(65) Prior Publication Data

US 2005/0157846 A1 Jul. 21, 2005

(51) Int. Cl.[7] ..... H01J 35/30
(52) U.S. Cl. ..... 378/137; 378/125
(58) Field of Search ..... 378/119–141

(56) References Cited

U.S. PATENT DOCUMENTS

| | | | | |
|---|---|---|---|---|
| 5,689,542 A | 11/1997 | Lavering et al. | ..... | 378/142 |
| 5,909,479 A | 6/1999 | Rother | ..... | 378/121 |
| 6,055,294 A | 4/2000 | Foerst et al. | ..... | 378/138 |
| 6,128,367 A | 10/2000 | Foerst et al. | ..... | 378/137 |
| 6,529,579 B1 | 3/2003 | Richardson | ..... | 378/130 |
| 6,751,293 B1 * | 6/2004 | Barrett | ..... | 378/144 |

FOREIGN PATENT DOCUMENTS

| | | |
|---|---|---|
| EP | 0 009 946 | 4/1980 |

* cited by examiner

*Primary Examiner*—Craig E. Church
*Assistant Examiner*—Jurie Yun
(74) *Attorney, Agent, or Firm*—Schiff Hardin LLP

(57) ABSTRACT

An X-ray source has an evacuated housing containing an interior space and a housing projection having a projection interior communicating with the interior space. A cathode is mounted in the projection interior and an anode is mounted in the interior space. Two tubes proceed substantially parallel to each other through the projection and are sealed relative to the projection interior, the two tubes being disposed on opposite sides of an electron beam that proceeds from the cathode to the anode during operation of the X-ray source. An electromagnetic electron beam deflector has a U-shape with two legs that are respectively disposed in the tubes. The electron beam deflector is controllable to generate a magnetic field that deflects the electron beam to set a position of the focus on the anode.

8 Claims, 3 Drawing Sheets

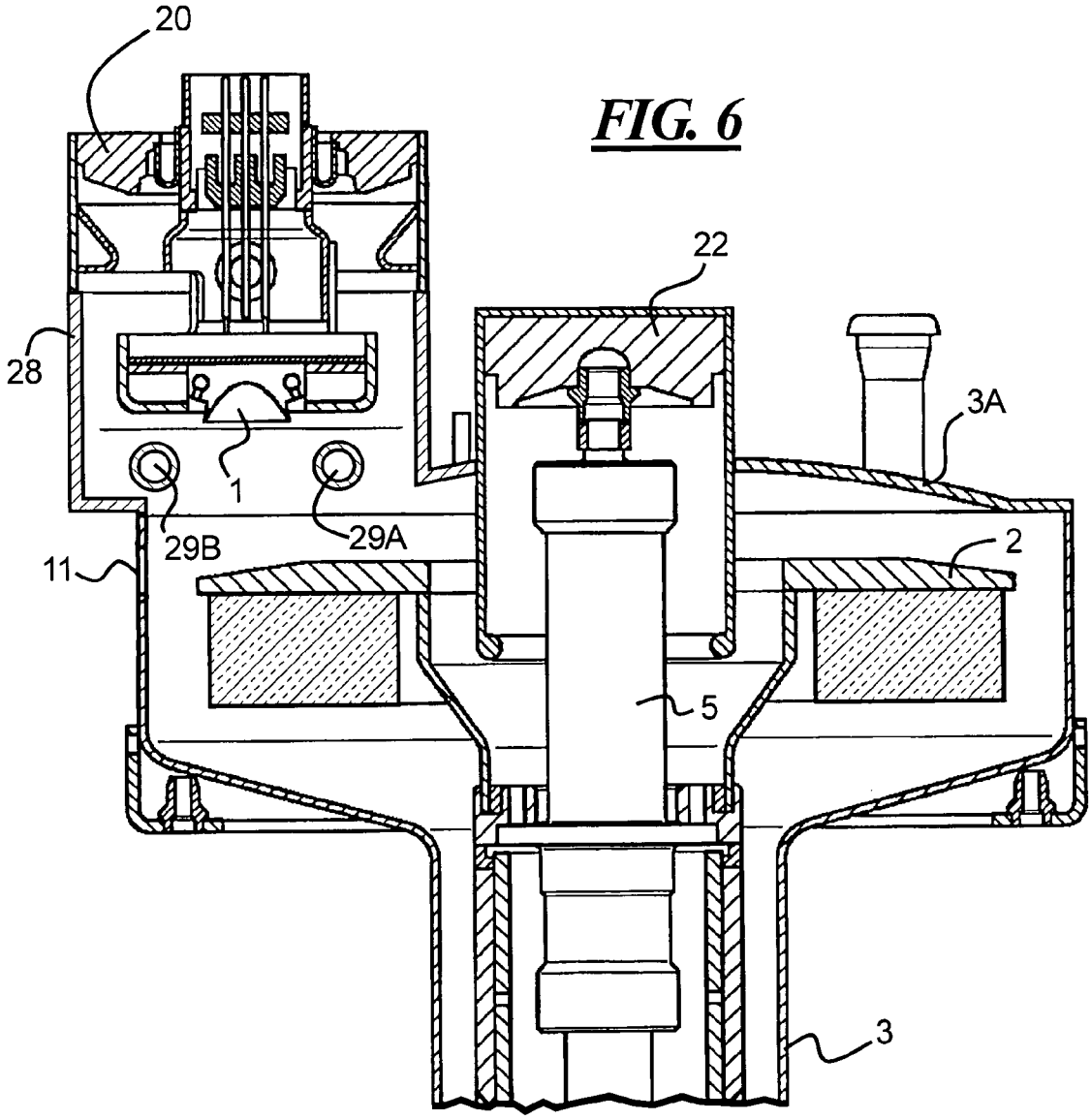
FIG. 6
FIG. 7
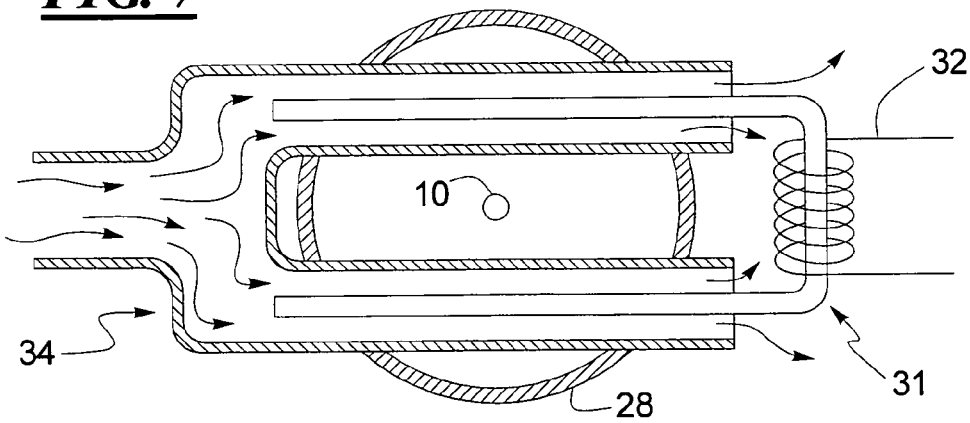

X-RAY TUBE WITH HOUSING ADAPTED TO RECEIVE AND HOLD AN ELECTRON BEAM DEFLECTOR

BACKGROUND OF THE INVENTION

1. Field of the Invention

The present invention is directed to a rotating anode X-ray tube, and in particular to a rotating anode X-ray tube of the type having a deflector that interacts with the electron beam proceeding from the cathode to the anode to influence the position of the focus on the anode.

2. Description of the Prior Art

In the case of a rotating anode X-ray tube, it is known to provide a vacuum housing wherein the rotating anode is mounted in a larger volume of the housing, and the cathode is disposed in a generally cylindrical projection of the housing, having an interior that communicates with the larger volume in which the anode is disposed. The cylindrical projection is connected to the larger volume of the housing by a neck having a reduced diameter compared to the cylindrical projection in which the cathode is disposed. The electron beam emitted by the cathode proceeds through this neck and strikes the anode at a focus, from which an X-ray beam emanates.

It is also known in a rotating anode X-ray tube having a housing configured in this manner to dispose a deflector, typically an electromagnetic deflector, at the exterior of the housing at the neck region. Such a deflector typically has a U-shape, with two generally parallel legs that straddle the neck region of the housing. This deflector is controlled to generate a magnetic field of a selected strength, to deflect the electron beam propagating from the cathode to the anode in a defined manner, so as to influence the position of the focus on the anode.

A rotating anode X-ray tube of the type described above is disclosed in U.S. Pat. No. 5,909,479.

The U-shaped beam deflector (yoke) is typically manufactured of stacked laminations, to reduce eddy current losses. Because of this laminated structure, the yoke cannot be effectively evacuated, and therefore it cannot be placed inside of the evacuated housing of such a rotating anode X-ray tube. This has conventionally necessitated its placement as described above, straddling the exterior of the neck region. The physical dimensions of the neck region thus impose a minimum distance between the electron beam and the deflector, which cannot be reduced in a conventional rotating anode tube of the type described above, due to the necessity of keeping the deflector at the exterior of the housing. In order to increase the effectiveness of the deflector, and allow the use of a magnetic deflection field having a lower field strength, therefore requiring less current to be supplied to the electromagnetic coil that generates the deflection field, it would be desirable if the deflector, or at least the legs thereof, could be disposed closer to the electron beam itself.

One possible way to accomplish this would be to make the deflector, or at least the legs thereof, out of solid material, rather than a stack of laminations, so that the evacuation problems associated with the laminate structure would be avoided, and thus the deflector could be placed inside the evacuated housing. As noted above, however, the laminate structure serves a beneficial purpose, namely minimizing eddy current losses, and therefore abandoning the laminated structure would be degrade the operation of the deflector.

Another possibility to reduce the distance between the deflector and the electron beam would be to make the neck region of the evacuated housing smaller in diameter. X-ray tubes, however, must be able to withstand relatively rugged usage, and therefore the neck region of the evacuated housing must have a certain size in order to provide the necessary mechanical stability to avoid a fracture at the neck region during usage of the X-ray tube. Rotating anode X-ray tubes typically are contained within a radiator housing that is filled with a coolant, such as oil. A fracture of the evacuated housing of the X-ray tube at any location is a serious problem, because not only is the vacuum then destroyed, precluding further operation of the X-ray tube, but also oil contained in the radiator housing can then leak into the interior of the evacuated housing.

SUMMARY OF THE INVENTION

It is an object of the present invention to provide a rotating anode X-ray tube of the type described above, wherein the distance between the electron beam deflector and the electron beam is reduced, while still allowing a beam deflector with a laminate structure to be employed.

The above object is achieved in accordance with the principles of the present invention in a rotating anode X-ray tube having an evacuated housing with a canister-shaped projection in which the cathode is disposed. The canister-shaped projection is in communication with a larger region of the evacuated housing, in which the anode is disposed, with the electron beam proceeding from the cathode through a communicating opening between the canister-shaped projection and the larger volume, and striking the anode (anode dish) in the larger volume. The canister-shaped projection has two parallel tubes proceeding therethrough which are open to the exterior of the canister-shaped projection, but which are sealed fluid-tight with respect to the interior of the canister-shaped projection. The tubes are disposed relatively close together, and the electron beam, during operation of the rotating anode X-ray tube, proceeds between the tubes in the interior of the canister-shaped projection. The legs of a U-shaped electron beam deflector of laminate construction are slid into the respective tubes, so that the deflector is disposed very close to the electron beam, thereby allowing highly effective and efficient deflection of the electron beam, and an associated accurate and efficient positioning of the focus on the anode.

Because the beam deflector is not disposed in the interior of the evacuated housing, the laminate structure of the beam deflector can still be employed, without imposing evacuation problems. The canister-shaped projection has a mechanically stable structure, and therefore even though the legs of the beam deflector are disposed much closer to the electron beam than in conventional rotating anode X-ray tubes of this type, the mechanical strength of the overall rotating anode X-ray tube is not compromised.

Moreover, because the tubes communicate with the exterior of the evacuated housing, they are in fluid communication with the interior of the radiator housing, in which the coolant, such as oil, is disposed. Typically, the radiator housing will have a suitable arrangement for circulating the coolant within the housing to promote heat dissipation and to avoid the formation of "hot spots." Either by virtue of this conventional circulation, or by the use of appropriately arranged baffles or fluid deflectors or conduits, some or all of the coolant can be caused to flow through the tubes, allowing the heat generated during operation of the beam deflector to be carried away.

DESCRIPTION OF THE DRAWINGS

FIG. 6 is a sectional view through the upper portion of a rotating anode X-ray tube constructed and operating in accordance with the principles of the present invention.

FIG. 7 is a sectional view through an embodiment of a cooling arrangement for the rotating anode X-ray tube in accordance with the principles of the present invention.

DESCRIPTION OF THE PREFERRED EMBODIMENTS

Figure 1:
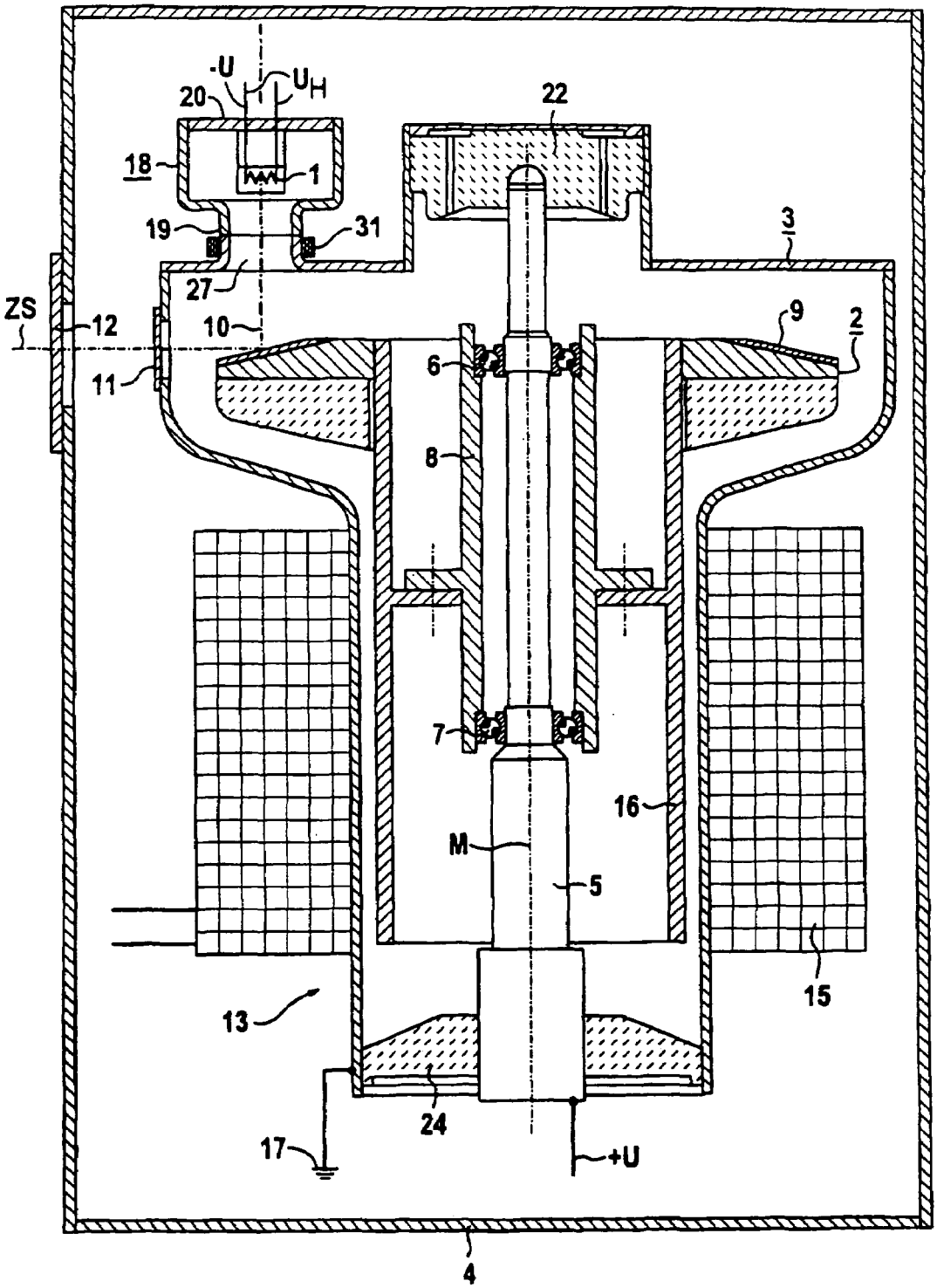
FIG. 1 (PRIOR ART)
FIG. 1 is a sectional view showing the basic components of a conventional rotating anode X-ray tube, of the type initially described.

FIG. 1 is a sectional view through a conventional rotating anode X-ray tube, as described in the aforementioned U.S. Pat. No. 5,909,479.

The X-ray tube according to FIG. 1 has a fixed cathode 1 and a rotating anode, generally referenced 2, that are arranged in a vacuum-tight evacuated housing 3 that is in turn disposed in a protective housing 4 filled with an electrically insulating, liquid cooling agent, for example insulating oil. The rotating anode 2 is rotatably mounted on a fixed shaft 5 in the vacuum housing 3 via two roller bearings 6 and 7 and a bearing sleeve 8.

The rotating anode 2, that is rotationally symmetric relative to the center axis M of the shaft 5, has an impact region that is provided with a layer 9 of tungsten-rhenium alloy, for example, that is struck by an electron beam 10 originating from the cathode 1 for the generation of X-rays. Only the center axis of the electron beam 10 is shown in FIG. 1, as a broken line. The interaction of the electron beam 10 with the layer 9 produces an X-ray beam, of which the central ray Z is shown in FIG. 1. The X-ray beam exits through beam exit windows 11 and 12 respectively provided in the vacuum housing 3 and the protective housing 4, and which are disposed in alignment with each other.

An electric motor 13, fashioned as a squirrel-cage motor in this embodiment, is provided for the drive of the rotating anode 2. The motor 13 has a stator 15 that is slipped onto the exterior of the vacuum housing 3, and a rotor 16 disposed inside the vacuum housing 3, that is connected to the rotating anode 2 in a rotationally fixed manner.

The vacuum housing 3 is made of a metallic material except for an insulator 20 that supports the cathode 1 and two insulators 22 and 24, and is at ground potential 17. The vacuum housing 3 has a region surrounding a space or volume 25, provided for the acceptance of the rotating anode 2, to which a chamber 18, provided for the acceptance of the cathode 1, is connected via shaft-shaped housing section 19. The cathode 1 is attached to the chamber 18 via the insulator 20. The cathode 1 is therefore located in a special chamber of the vacuum housing 3, which is connected to the vacuum housing 3 via the shaft-shaped housing section or neck 19.

The shaft 5 is at a positive high voltage +U for the rotating anode 2. The tube current therefore flows via the roller bearings 6 and 7.

One terminal of the cathode 1 is at a negative high voltage −U, as schematically indicated in FIG. 1. The filament voltage $U_H$ is across the two terminals of the cathode 1. The lines leading to the cathode 1, the shaft 5, the vacuum housing 3 and the stator 15 are in communication with a voltage supply (not shown) of a known type situated outside the protective housing 4, that supplies the necessary voltages for the operation of the X-ray tube. The X-ray tube according to FIG. 1 thus is of a type known as a two-pole X-ray tube.

As shown in FIG. 1, the electron beam 10 that originates from the cathode 1 propagates through the shaft-shaped housing section 19 to the rotating anode 2. The housing section 19, therefore, limits a diaphragm aperture 27. The dimensions of the diaphragm aperture 27 are selected so that they do no significantly exceed the dimensions that are necessary for an unimpeded passage of the electron beam 10.

At least the chamber 18, the shaft-shaped housing section 19, and the upper wall 3A (see FIGS. 2–6), and preferably all parts of the vacuum housing 3, are made of non-magnetic material, for example stainless steel, and limit an annular space that is radially open to the exterior of the vacuum housing 3. An electromagnet 31, schematically indicated in FIG. 1, is arranged in this annular space, and serves as a deflector to generate a magnetic deflecting field for the electron beam 10. The electron beam 10 is deflected perpendicularly to the plane of the drawing of FIG. 1.

The electromagnet (deflector) 31 includes a winding or coil 32 (see FIGS. 2, 3 and 5) that is connected with a current source (not shown), allowing a current to flow in the coil 32 during the operation of the X-ray tube. The intensity of the current and the timing thereof are selected to produce a magnetic field to cause a desired deflection behavior of the electron beam 10, thereby influencing the position of the focus of the electron beam 10 on the surface 9, from which the X-ray beam emanates.

As discussed above, the physical dimensions of the housing section 19 impose a minimum distance, that cannot be reduced, between the electron beam deflector 31 and the electron beam 10. The deflector 31, or at least the legs 33A and 33B thereof (see FIGS. 2, 3 and 5) are composed of a packet or stack of laminations of ferromagnetic material, so as to reduce eddy current losses in the operation of the deflector 31. Such a laminate structure cannot be properly evacuated, thereby precluding the deflector 31 from being located inside of the vacuum housing 3. This means that the magnetic field that is generated by the beam deflector 31 must have a minimum field strength in order to effectively influence the electron beam 10, which in turn means that current supplied to the coil 32 must have a minimum amplitude, which cannot be reduced. This not only limits the efficiency of the deflection that can be achieved, but also contributes to heat generation.

These and other problems are avoided in accordance with the present invention by providing a canister-shaped projection 28 on the top 3A of the vacuum housing 3, in place of the chamber 18 and the housing portion 19 shown in the conventional rotating anode X-ray tube of FIG. 1. Such a canister-shaped projection 28 is shown in different views in FIGS. 2, 3, 4 and 5, and in a sectional view in FIG. 6. The remainder of the X-ray source according to the invention is as shown in FIG. 1.

Figure 2:
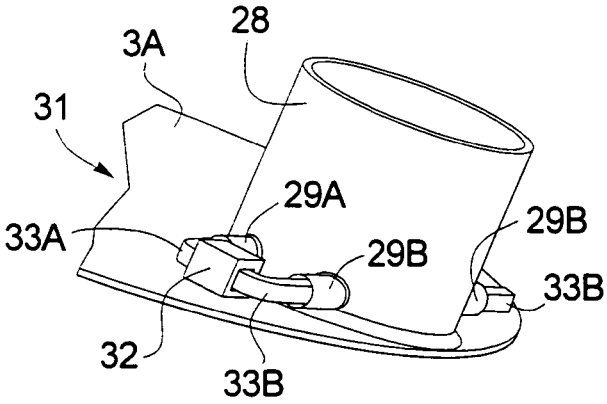
FIG. 2 is a first perspective view of the exterior of the vacuum enclosure of the rotating anode X-ray tube in accordance with the invention, with the electron beam deflector inserted.
Figure 3:
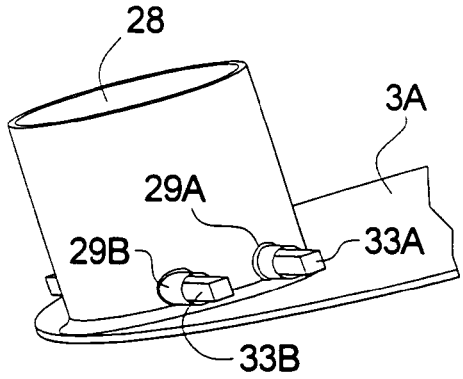
FIG. 3 is a second perspective view of the exterior of the vacuum enclosure of the rotating anode X-ray tube in accordance with the invention, with the electron beam deflector inserted.
Figure 4:
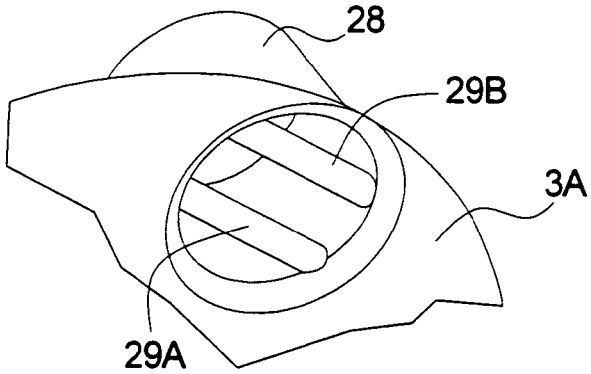
FIG. 4 is a view from below of the top of the vacuum enclosure of the rotating anode X-ray tube in accordance with the invention.
Figure 5:
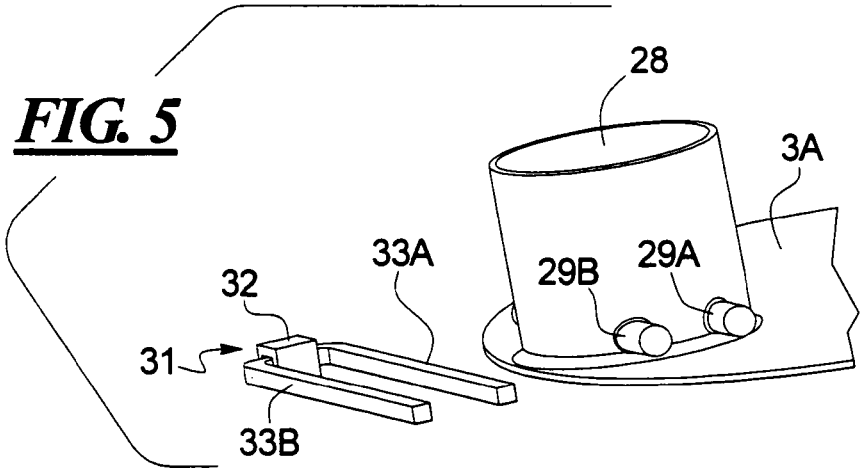
FIG. 5 is a perspective view of the exterior of the vacuum enclosure of the rotating anode X-ray tube in accordance with the invention, with the electron beam deflector removed.

FIGS. 2, 3 and 5 show exterior views of the canister-shaped projection 28, and FIG. 4 shows a view of the canister-shaped projection 28 from below, showing that it has an opening in the top 3A, allowing communication between the interior of the canister-shaped projection 28 and the remainder of the vacuum housing 3.

As shown in FIG. 6, the canister-shaped projection 28 accommodates the cathode 1 in the same manner as the chamber 18 in the conventional tube shown in FIG. 1.

As shown in FIGS. 2–6, the canister-shaped projection 28 has two tubes 29A and 29B which proceed through a lower portion thereof. The tubes 29A and 29B are open to the exterior of the canister-shaped projection 28, and thus are open to the exterior of the vacuum housing 3, but are sealed with respect to the interior of the canister-shaped projection 28, and thus with respect to the interior of the vacuum housing 3. The tubes 29A and 29B respectively receive the legs 33A and 33B of the beam deflector 31. As can be seen from FIG. 4, the tubes 29A and 29B can be spaced relatively close together, with the electron beam 10 proceeding between the tubes 29A and 29B as it propagates from the cathode 1 to the anode 2. The legs 33A and 33B of the beam deflector 31, therefore, can be placed, in the tubes 29A and 29B, much closer to the electron beam 10 than in the conventional arrangement shown in FIG. 1. More effective control of the deflection of the electron beam 10 thus can be achieved, with a lower field strength, and thus a lower current supplied to the coil 32.

Since the tubes 29A and 29B are open to the exterior of the vacuum housing 3, they are in fluid communication with the interior of the protective housing 4. Therefore, the coolant, such as insulating oil, contained in the protective housing 4, which is used for cooling the rotating anode X-ray tube contained therein, also can be used to cool the interior of the tubes 29A and 29B, thereby allowing heat generated during the operation of the beam deflector 31 to be carried away. The conventional cooling circulation arrangement used in the protective housing 4 can be adequate for this purpose, however, it is also possible for baffles or fluid deflectors to be provided to direct a specific flow of the coolant through the tubes 29A and 29B. More elaborately, a conduit arrangement 34 in which coolant flows can be placed in fluid connection with the tubes 29A and 29B, as shown in FIG. 7.

The rotating anode X-ray tube in accordance with the invention, as shown in FIG. 6, like the conventional X-ray tube shown in FIG. 1, is a two-pole X-ray tube. It will be appreciated, however, that the X-ray tube of the invention can alternatively be a single-pole X-ray tube, in which case the vacuum housing 3 and the rotating anode 2 are then at the same potential, namely ground potential 17, whereas the negative high voltage –U is at the cathode 1.

Although modifications and changes may be suggested by those skilled in the art, it is the intention of the inventors to embody within the patent warranted hereon all changes and modifications as reasonably and properly come within the scope of their contribution to the art.

We claim as our invention:

1. An X-ray source comprising:

an X-ray tube having an evacuated housing containing an interior space;

said housing having a housing projection containing a projection interior communicating with said interior space;

a cathode mounted in said projection interior and a rotating anode mounted in said interior space, said cathode emitting an electron beam that proceeds along an electron beam path and strikes said anode at a focus, from which X-rays are generated;

two tubes proceeding substantially parallel to each other through said projection and being sealed relative to said projection interior; and an electromagnetic electron beam deflector having a U-shape with two legs, said legs being respectively disposed in said tubes, said electron beam deflector being controllable to generate a magnetic field that deflects said electron beam to set a position of the focus on the anode.

2. An X-ray source as claimed in claim 1 wherein said electron beam deflector is comprised of a packet of stacked laminations of ferromagnetic material.

3. An X-ray source as claimed in claim 1 wherein said projection is canister-shaped.

4. An X-ray source as claimed in claim 1 further comprising a protective housing surrounding said evacuated housing, said protective housing having an interior in fluid communication with an interior of each of said tubes, and said protective housing containing a fluid coolant in said interior and in the interior of each of said tubes.

5. An X-ray source as claimed in claim 1 wherein said tubes are disposed in a plane substantially perpendicular to said electron beam path.

6. A method for adjusting a position of a focus of an electron beam on an anode in an X-ray tube, comprising the steps of:

disposing a rotating anode in an interior space of an evacuated housing;

disposing a cathode in a projection interior of a projection of said housing in communication with said interior space;

disposing two tubes substantially parallel to each other in said projection and sealing said tubes relative to said projection interior;

inserting respective legs of an electromagnetic U-shaped magnetic field generator in said tubes;

operating said cathode to emit an electron beam that proceeds from said cathode in a path in said projection interior between said tubes, and strikes said anode at a focus at which X-rays are generated; and while said electron beam is emitted, operating said magnetic field generator with a controlled current to generate a magnetic field that interacts with said electron beam, and selectively deflects said electron beam, to adjust a position of the focus on said anode.

7. A method as claimed in claim 6 comprising employing a packet of stacked laminations of ferromagnetic material as said magnetic field generator.

8. A method as claimed in claim 6 comprising cooling said evacuated housing during generation of said X-rays with fluid coolant that flows through said tubes.

* * * * *